US009003601B2

(12) United States Patent
Hwang et al.

(10) Patent No.: US 9,003,601 B2
(45) Date of Patent: Apr. 14, 2015

(54) VACUUM CLEANER

(75) Inventors: Geun-Bae Hwang, Changwon-si (KR); Kyuchun Choi, Changwon-si (KR); Chungook Chong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 475 days.

(21) Appl. No.: 13/498,664

(22) PCT Filed: Nov. 4, 2009

(86) PCT No.: PCT/KR2009/006455
§ 371 (c)(1),
(2), (4) Date: Mar. 28, 2012

(87) PCT Pub. No.: WO2011/055864
PCT Pub. Date: May 12, 2011

(65) Prior Publication Data

US 2012/0180253 A1 Jul. 19, 2012

(51) Int. Cl.

| | |
|---|---|
| ***A47L 9/20*** | (2006.01) |
| ***A47L 9/10*** | (2006.01) |
| ***A47L 9/19*** | (2006.01) |
| *A47L 9/28* | (2006.01) |

(52) U.S. Cl.
CPC ..... *A47L 9/108* (2013.01); *A47L 9/2805* (2013.01); *A47L 9/20* (2013.01); *A47L 9/19* (2013.01)

(58) Field of Classification Search
CPC ..... A47L 5/00; A47L 9/20; A47L 9/108; A47L 9/2805
USPC ..... 15/347, 353, 339
IPC ..... A47L 5/00, 9/10, 9/20
See application file for complete search history.

(56) References Cited

FOREIGN PATENT DOCUMENTS

| | | |
|---|---|---|
| JP | 2008-132111 | 6/2008 |
| JP | 2008-301878 | 12/2008 |
| KR | 10-0871487 | 12/2008 |

OTHER PUBLICATIONS

International Search Report issued in PCT Application No. PCT/KR2009/006455 dated Jul. 28, 2010.

*Primary Examiner* — David Redding
(74) *Attorney, Agent, or Firm* — Ked & Associates, LLP

(57) ABSTRACT

The present disclosure relates to a vacuum cleaner
A vacuum cleaner of the disclosure includes a body, a dust collecting unit disposed at one side of the body and provided with a dust collecting container storing the dust, a pressurization member compressing the dust stored in the dust collecting container, a driving device operating the pressurization member, and a dust emptying notification unit noticing the dust emptying time by visualizing a storage condition of the dust within the dust collecting container while sliding-moving by operating the pressurization member.
In the disclosure, the accommodating condition of the dust for the dust collecting unit can be easily shown.

16 Claims, 21 Drawing Sheets

VACUUM CLEANER

BACKGROUND OF THE INVENTION

1. Technical Field

The present disclosure relates to a vacuum cleaner and, more particularly, to the vacuum cleaner showing fullness of a dust container to the outside.

2. Description of the Related Art

In general, the vacuum cleaner is an apparatus suctioning a dust and a foreign material along with air and filtering them at the inside of a body using a suction motor mounted at the inside of a body.

The vacuum cleaner having the same function as above includes a canister type in which a nozzle, that is, a suction port is disposed aside from the body and is communicated with the body through a connection tube, and a upright type in which the nozzle is formed integrally with the body.

In the vacuum cleaner divided as above, the dust collecting device of a bag filter type or cyclone dust collecting type may be used to filter and store the dust and the foreign material among the air. However, most of the vacuum cleaner launched recently adapts the dust collecting device of cyclone dust collecting type due to reasons such as ease of use and maintenance costs.

On the other hand, a cyclone dust collecting type of the dust collecting unit is configured to be collected after separating the dust and foreign material from the air suctioned using centrifugal force.

To this end, the dust collecting unit includes a dust collecting body, a suction port suctioning the air into the inside of the dust collecting body, a cyclone portion separating the dust and foreign material from the air suctioned to the dust collecting body, a dust container storing the dust and foreign material separated by the cyclone portion, and a discharge port discharging the air separated by the cyclone portion into the outside.

In a prior dust collecting unit as above, as time passes, the dust and foreign material collected into the inside of the dust container are increased to fill up the dust container. When such a situation happens, suction performance of the vacuum cleaner is lowered and overload for a suction motor may be generated. Therefore, it is required to check accommodation condition of the dust and foreign material for the container and to empty the dust container.

In recent years, efforts to enable fullness of the dust container for the vacuum cleaner to visually check has been continued.

SUMMARY OF THE INVENTION

An object of the disclosure is to provide the vacuum cleaner to enable fullness of the dust container to show to the outside using a moving unit rotating when compressing the dust and a follower being interlocked with the moving unit and sliding-moving.

Another object of the closure is to the vacuum cleaner to enable color information showed to the outside of the dust container to change while varying mechanical interference between the moving unit and the follower according to the compression condition of the dust within the dust container.

Another object of the closure is to the vacuum cleaner, in which the moving unit and the follower have magnetism, to enable power supply to selectively supply to a notification portion showing fullness of the dust container while sliding-moving the follower by attractive force and repulsive force acting according to the compression condition of the dust within the dust container.

A vacuum cleaner of the disclosure includes a body, a dust collecting unit disposed at one side of the body and provided with a dust collecting container storing the dust, a pressurization member compressing the dust stored in the dust collecting container, a driving device operating the pressurization member, and a dust emptying notification unit noticing the dust emptying time by visualizing a storage condition of the dust within the dust collecting container while sliding-moving by operating the pressurization member.

In the disclosure, when the dust emptying notification unit noticing accommodating degree of the dust accommodated into the inside of the dust collecting unit for the vacuum cleaner of the outside through the color information to be varied rotates and moves by the pressurization member compressing the dust container, the color information showed to the outside of the dust collecting unit or the cleaner body is configured to be varied.

Further, the dust emptying notification unit of the same function as above is mechanically interfered with the pressurization member or is configured to move by the magnetism, thereby more stably showing the accommodating condition of the dust for the dust collecting unit.

Further, the dust emptying notification unit is configured as above, thereby easily performing the maintenance and repair.

DESCRIPTION OF THE PREFERRED EMBODIMENTS

Hereinafter, the disclosure will be described in detail with reference to drawings.

Figure 1:
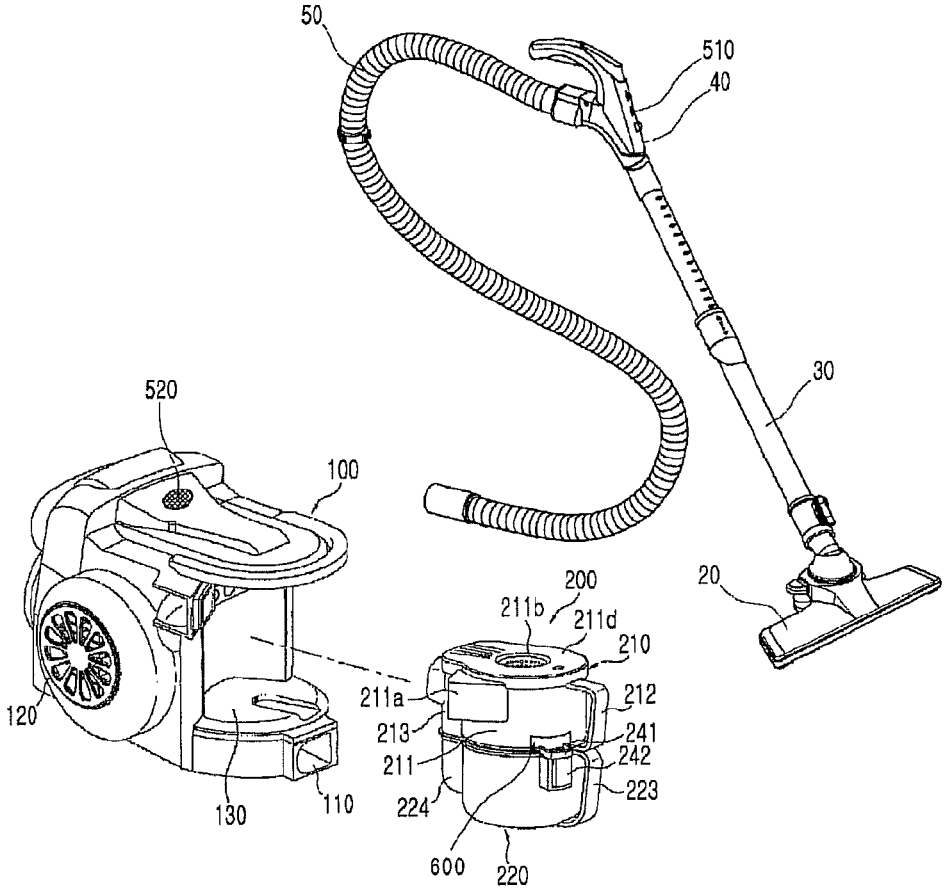
FIG. 1 is a perspective view of a vacuum cleaner according to the disclosure.
Figure 2:
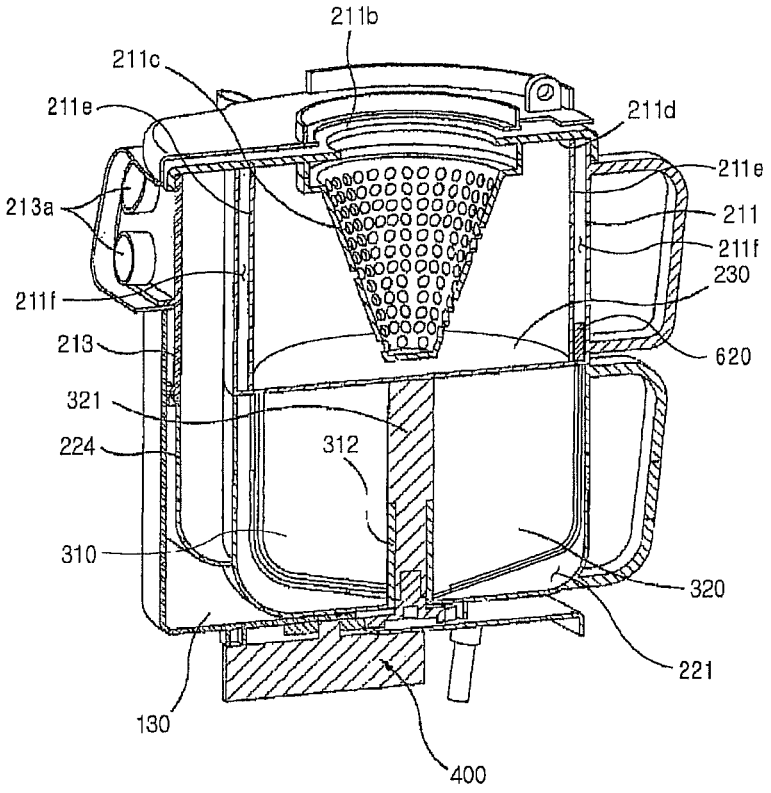
FIGS. 2 and 3 show a detailed configuration of a dust collecting unit, i.e., the principal part of the vacuum cleaner according to the disclosure.
Figure 3:
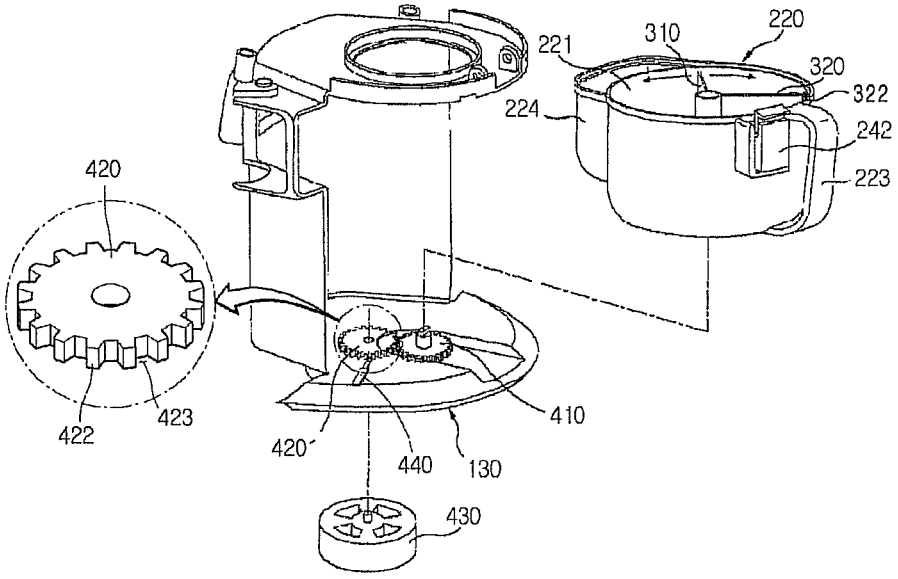

FIG. 1 is a perspective view of a vacuum cleaner according to the disclosure. FIGS. 2 and 3 show a detailed configuration of a dust collecting unit, i.e., the principal part of the vacuum cleaner according to the disclosure.

In these drawings, the vacuum cleaner according to the disclosure includes a cleaner body 100 disposing a suction motor (not shown) generating a suction force into the inside, and a dust collecting unit 200 separating and storing the dust included in the suctioned air.

Further, the cleaner body 100 includes a suction nozzle suctioning air containing the dust, a handle 40 to be grabbed by the user, an extension tube 30 connecting the handle 40 and the suction nozzle 20, and a connection hose 50 connecting the handle 40 and the cleaner body 100. Therefore, it is configured that the dust and the air suctioned through the suction nozzle 20 are collected and stored into the cleaner body 100. In the disclosure, since basic configurations such as the suction nozzle 20, the extension tube 30, the handle 40 and the connection hose 50 become the same configurations as the previous embodiment, the detailed description thereof will be omitted.

On the other hand, the front bottom end portion of the cleaner body 100 is provided with the suction unit 110 of the body suctioning air containing the dust suctioned from the suction nozzle 20.

Further, one side of the cleaner body 100 is provided with a discharge portion 120 of the body discharging the air separated from the dust into the outside of the body.

On the other hand, the dust collecting unit 200 includes a dust separation portion 210 separating the dust contained in the suctioned air, a dust collecting container 220 storing the dust separated from the dust separation portion, and a partition plate 230 disposed at the space between the dust separation portion 210 and the dust collecting container 220.

The dust separation portion 210 is coupled with the top of the dust collecting container 220 and the air separated from the dust in the dust separation portion 210 is moved into the bottom thereof to store to the inside of the dust collecting container 220.

In detail, an outer periphery side of the top of the dust separation portion 210 is provided with the suction port 211*a* formed in the tangential direction to the dust separation portion 210 and suctioning the air containing the dust, and the top of the dust separation portion 210 is detachably provided with a cover 221*d*.

The center of the cover 221*d* is provided with a discharge port 211*b* discharging the air separated from the dust by the inside of the dust separation portion 210, i.e., a cyclone portion 211.

A hollowness type of discharge member 211*c* is coupled with the discharge port 211*b*, and the outer periphery side of the discharge member 211*c* is provided with a number of through-hole discharging the air passing a dust separation process at the cyclone portion 211.

The bottom of the dust separation portion 210 is horizontally provided with the partition plate 230.

Such a partition plate 230 serves to partition the dust separation portion 210 and the dust collecting container 220. Further, the partition plate 230 also prevents the dust stored in the inside of the dust collecting container 220 from scattering into the dust separation portion 210 when the dust separation portion 210 is coupled with the dust collecting container 220.

Further, the partition plate 230 is provided with the dust discharge port 231 discharging the dust separated at the cyclone portion 211 into the dust collecting container 220.

On the other hand, the dust separation portion 210 is provided with an upper handle 212 and a lower handle 223, respectively, to couple the dust separation portion 210 and the dust collecting container 220.

Further, when the dust collecting container 220 is mounted in the dust separation portion 210, the dust collecting unit 200 is provided with a hook device to enable the dust separation portion 210 and the dust collecting container 220 to couple.

In detail, the bottom end of outer periphery side of the dust separation portion 210 is provided with a hook hanger 241, and the top of periphery side of the dust collecting container 220 is provided with a hook portion 242 selectively coupling with the hook hanger 241.

On the other hand, the dust collecting unit 200 is detachably mounted in a front of the cleaner body 100. Therefore, the cleaner body 100 is provided with a dust collecting device mounting portion 130 mounting the dust collecting unit 200.

In addition, the dust collecting unit 200 is provided with a pair of pressurization member 310, 320 reducing volume of the dust stored in the dust storage portion 221 and therefore increasing dust collecting capacity of the dust.

Here, a pair of pressurization member 310, 320 compresses the dust and reduces volume of the dust by interactions with each other. Therefore, a maximum dust collecting capacity of the dust collecting container 220 is increased by increasing a density of the dust stored to the inside of the dust collecting container 220.

In the following description for convenience, one of a pair of pressurization members 310, 320 is called a first pressurization member 310 and the other is called a second pressurization member 320.

In the disclosure, at least one of a pair of pressurization members 310, 320 is movably disposed at the inside of the dust collecting container 220 to compress the dust at a space between a pair of pressurization members 310, 320.

That is, when the first pressurization member 310 and the second pressurization member 320 is revolvably disposed at the inside of the dust collecting container 220, the first pressurization member 310 and the second pressurization member 320 are rotating-moving toward each other. At this time, a gap between one of the first pressurization member 310 and one of the second pressurization member 320 facing one of the first pressurization member 310 is narrowed to compress the dust positioned at the space between the first pressurization member 310 and the second pressurization member 320.

In the disclosure, the first pressurization member 310 is fixed to the inside of the dust collecting container 220, and the second pressurization member 320 is revolvably provided in the inside of the dust collecting container 220.

Therefore, the first pressurization member 310 becomes a fixing member and the second pressurization member 320 becomes a rotating member.

On the other hand, the inside of the dust collecting container 220 is provided with the dust storage portion 221 forming the space storing the dust. Further, the dust storage portion 221 is formed to surround a virtual trajectory drew when free end of the second pressurization member 320 rotates.

In detail, it is preferable that the first pressurization member 310 is provided in the space between the inner periphery of the dust storage portion 221 and the axial line of rotation axis 321 becoming the rotation center of the second pressurization member 320.

That is, the first pressurization member 310 is mounted in the side connecting the axial line of the rotation axis 321 and the inner periphery of the dust storage portion 221. At this time, the first pressurization member 310 perfectly or partly shields the space between the inner periphery of the dust storage portion 221 and the axial line of the rotation axis 321 to compress the dust by interaction with the second pressurization member 320 when the dust flows by the second pressurization member 320.

To this end, it is preferable that one end 312 of the first pressurization member 310 is integrally formed in the inner periphery of the dust storage portion 221 and the other end is integrally formed in the fixing axis 312 disposed at coaxial with the rotation axis 321 of the second pressurization member 320.

Of course, one end of the first pressurization member 310 only may be integrally formed in the inner periphery of the dust storage portion 221 and the other end only may be integrally formed in the fixing axis 312. In other words, the first pressurization member 310 is fixed to at least any one side of the inner periphery of the dust storage portion 221 and the fixing axis 312.

It is preferable that the first pressurization member 310 and the second pressurization member 320 are configured by a plate of rectangular shape.

Further, it is preferable that the rotation axis 321 of the second pressurization member 320 is disposed at coaxial with the axial line becoming the center of the dust storage portion 221.

That is, the fixing axis 312 is protruded toward the inside at one end of the dust storage portion 221, and the inside of the fixing axis 312 is provided with the hollowness to be penetrated in the axis direction to assemble the rotation axis 321. As a result, a predetermined portion of the rotation axis 321 is inserted into the hollowness from the top of the fixing axis 312.

On the other hand, an interference protrusion 322 to be protruded upward is also formed in the top of the second pressurization member 320.

The interference protrusion 322 is interfered with a slider 620, i.e., one configuration of the dust emptying notification unit 600 to be described below to move the slider 620.

To this end, A partition wall 211*e* to be spaced at a predetermined distance is formed in the inside of the cyclone portion 211, and the space between the partition wall 211*e* and the cyclone portion 211 is provided with a sliding groove 211*f* sliding-moving the slider 620.

Here, the slider 620 is configured by a pair of plates having a curvature corresponding to the curvature of the cyclone portion 211 and the partition wall 211*e*, and is formed to have colors distinguished from a fixing plate 610, i.e., another one configuration of the dust emptying notification unit 600 described above to slide in front of the fixing plate 610.

That is, the dust emptying notification unit 600 of principal parts of the disclosure includes a pair of slider 620 disposed at the inside of the cyclone portion 211 and sliding-moving while interfering with the second pressurization member 320, and the fixing plate disposed at the lateral side of the slider 620 and changing the range to be exposed to the outside of the cyclone portion 211 according to moving position of the slider 620.

In the following description for convenience, one of a pair of slider 620 is called a first slider 622 and the other is called a second slider 624.

The fixing plate 610 is formed as the portion of the partition wall 211*e*, and is formed by colors different from that of the slider 620. In addition, it may be formed that the fixing plate 610 has a height corresponding to or slightly lower than the height of the slider 620 and has a width corresponding to, or slightly wider or narrower than the width of the slider 620.

Further, the sliding groove 211*f* is provided with a center stopper 632 formed to be protruded from the cyclone portion 211 of position corresponding to a front center or center of the fixing plate 610 and limiting movement of the first slider 622 and the second slider 624.

Figure 4:
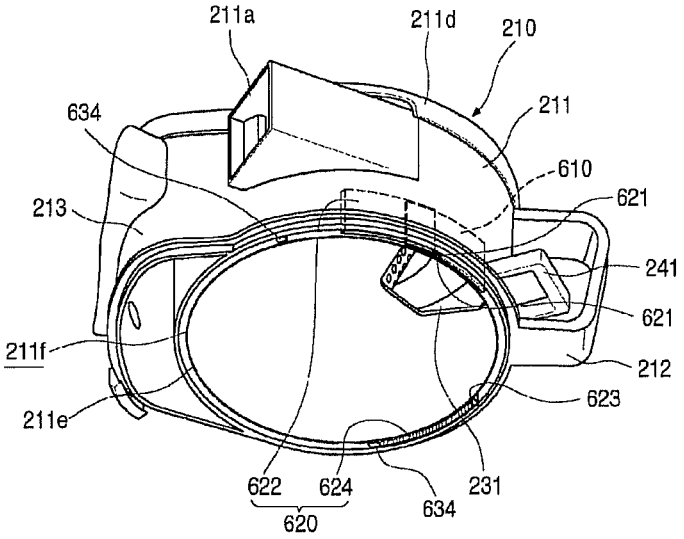
FIG. 4 shows an embodiment of a dust emptying notification unit, i.e., the principal part of the vacuum cleaner according to the disclosure.

Therefore, in the FIG. 4, when the first slider 622 located on the left around the fixing plate 610 and the second slider 624 located on the right contact the center stopper 632, roughly half of the fixing plate 610 is shielded, and the slider 620 shielding the fixing plate 610 is exposed to the outside of the cyclone portion 211.

That is, when the slider 620 is moved into the front of the fixing plate 610, the fixing plate 610 is shielded to show colors of the slider 620 to the outside. To this end, it is preferable that at least the outer side of the cyclone portion 211 corresponding to position forming the fixing plate 610 is formed transparently.

Further, a side stopper 634 limiting movement of the slider 620 just like the center stopper 632 is also formed in the sliding groove 211*f*.

The side stopper 634 includes at least one side stopper 634 disposed at intervals wider than the width of the first slider 622 in the left end of the fixing plate 610 and limiting the left moving range of the first slider 622, and at least another one side stopper 634 disposed at intervals wider than the width of the second slider 624 in the right end of the fixing plate 610 and limiting the right moving range of the second slider 624.

Therefore, the moving position of the first slider 622 and the second slider 624 are limited, and the first slider 622 and the second slider 624 are moved into position contacting the side stopper 634, respectively, not to shield the fixing plate 610.

On the other hand, the slider 620 is provided with the hanger protrusion 621, 623 to be contacted with the interference protrusion 322 and moving the slider 620.

In detail, the first slider 622 is provided with the first hanger protrusion 621 to be protruded toward the bottom at the bottom end in the direction facing the center stopper 632, and the second slider 624 is provided with the second hanger protrusion 623 to be protruded toward the bottom at the bottom end in the direction facing the center stopper 632.

Here, the first hanger protrusion 621 and the second hanger protrusion 623 is formed so that the side thereof to be contacted with the interference protrusion 322 has a the left/right slant all and moves to be contacted with the interference protrusion 322. When the power is continually applied to the first hanger protrusion 621 and the second hanger protrusion 623 to be contacted with the side stopper 634 or the central stopper 632, the interference protrusion 322 may overstride the slant side.

In addition to above configuration, the vacuum cleaner of the disclosure is connected to the rotation axis 321 of the second pressurization member 320, and further includes the driving device 400 rotating the second pressurization member 320.

The driving device 400 includes a driving motor 430 generating a driving force, and a power transmission portion 410, 420 rotating the second pressurization member 320 by transmitting the driving force of the driving motor 430 to the second pressurization member 320.

In detail, the power transmission portion 410, 420 includes a passivity gear 410 coupled with the rotation axis 321 of the second pressurization member 320, and a driving gear 420 transmitting the power to the passivity gear 410.

Further, the driving gear 420 is coupled with a motor axis of the driving motor 430 and is rotated by the driving motor 430.

Therefore, the driving gear 420 coupled with the driving motor 430 is rotated by rotating the driving motor 430, the rotating force of the driving motor 430 is transmitted into the passivity gear 410 by the driving gear 420 to rotate the passivity gear 410. Finally, the second pressurization member 320 is rotated by rotating the passivity gear 410.

Here, the driving motor 430 is disposed at the bottom of the dust collecting unit mounting portion 130, and the driving gear 420 to be coupled with the rotating axis of the driving motor 430 is disposed at a bottom surface of the dust collecting unit mounting portion 130.

Further, the portion of the outer periphery side of the driving gear 420 is exposed to the outside in the bottom of the dust collecting unit mounting portion 130

To this end, a motor accommodating portion (not shown), in which the driving motor is mounted, is preferably formed in a underfloor of the dust collecting unit mounting portion 130, and an opening 131 exposing the portion of the periphery side of the driving gear 420 to the outside is formed in the bottom of the dust collecting unit mounting portion 130.

On the other hand, the rotation axis 321 of the second pressurization member 320 is inserted into the hollowness of the fixing axis 312 from the top of the fixing axis 312, and the passivity gear 410 is inserted into the hollowness of the fixing axis 312 from the bottom of the dust collecting container 220 to couple with the rotation axis 321.

Therefore, when the passivity gear 410 is coupled with the rotation axis 321 as above, the passivity gear 410 is exposed to the outside of the dust collecting container 220.

Thus, the passivity gear 410 is exposed to the outside of the dust collecting container 220 and therefore, if the dust collecting unit 200 is mounted in the dust collecting unit mounting portion 130, the passivity gear 410 is engaged in the driving gear 420.

On the other hand, it is preferable that the driving motor 430 becomes a motor to be rotated by normal rotation and backlashing.

In other words, the motor to be rotated in both directions may be used as the driving motor 430.

A synchronous motor may be used as the driving motor 430 to rotate in the both directions.

The synchronous motor is configured to rotate in the both directions by the motor itself, and if the force applied to the motor is above the set value when rotating the motor in one direction, the rotation direction of the motor is changed into another direction.

At this time, the force applied to the motor is a resistance force (torque) generated by pressurizing the dust by the second pressurization member 320. When the resistance force reaches the set value, the rotation direction of the motor is changed.

The synchronous motor is generally known in the art related to the motor, so detailed description about it will be omitted.

Hereinafter, an action of the disclosure will be described with reference to drawings.

Figure 5:
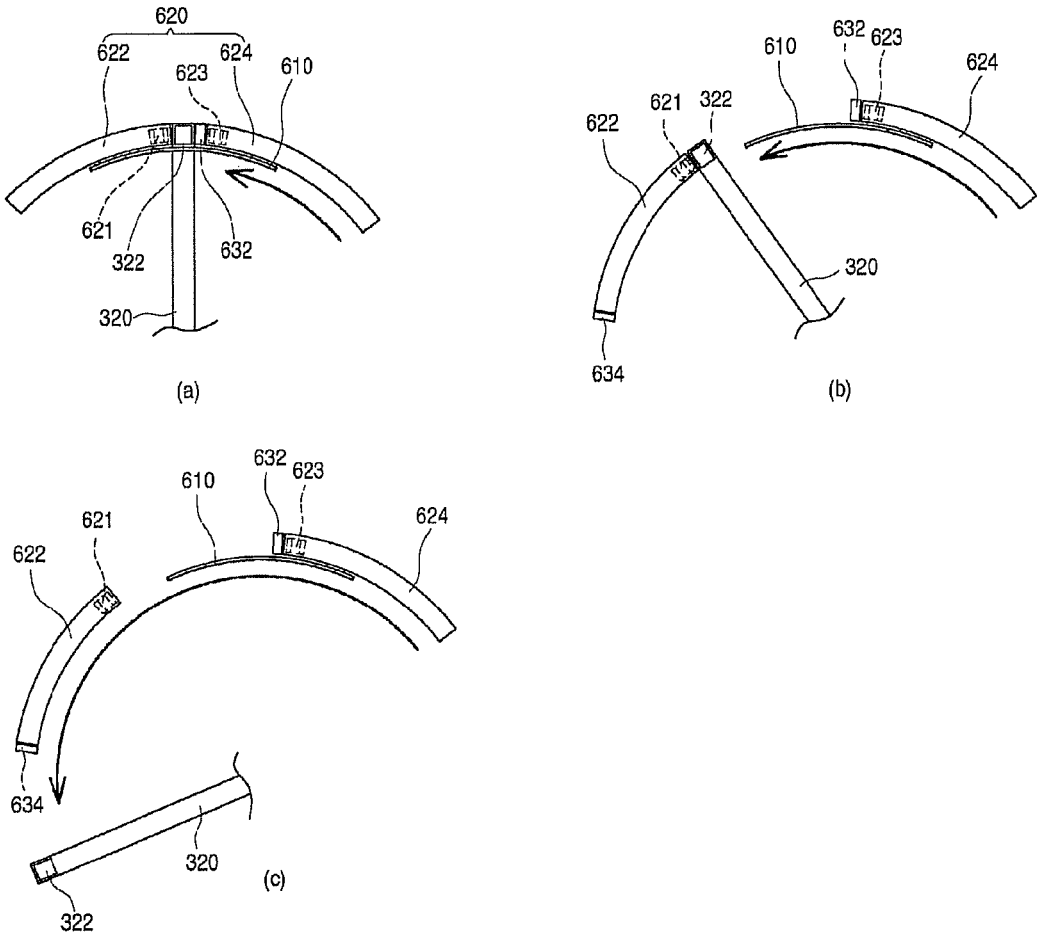
FIGS. 5 to 7 shows processes visualizing emptying condition of the dust through the dust emptying notification unit showed in FIG. 4.
Figure 6:
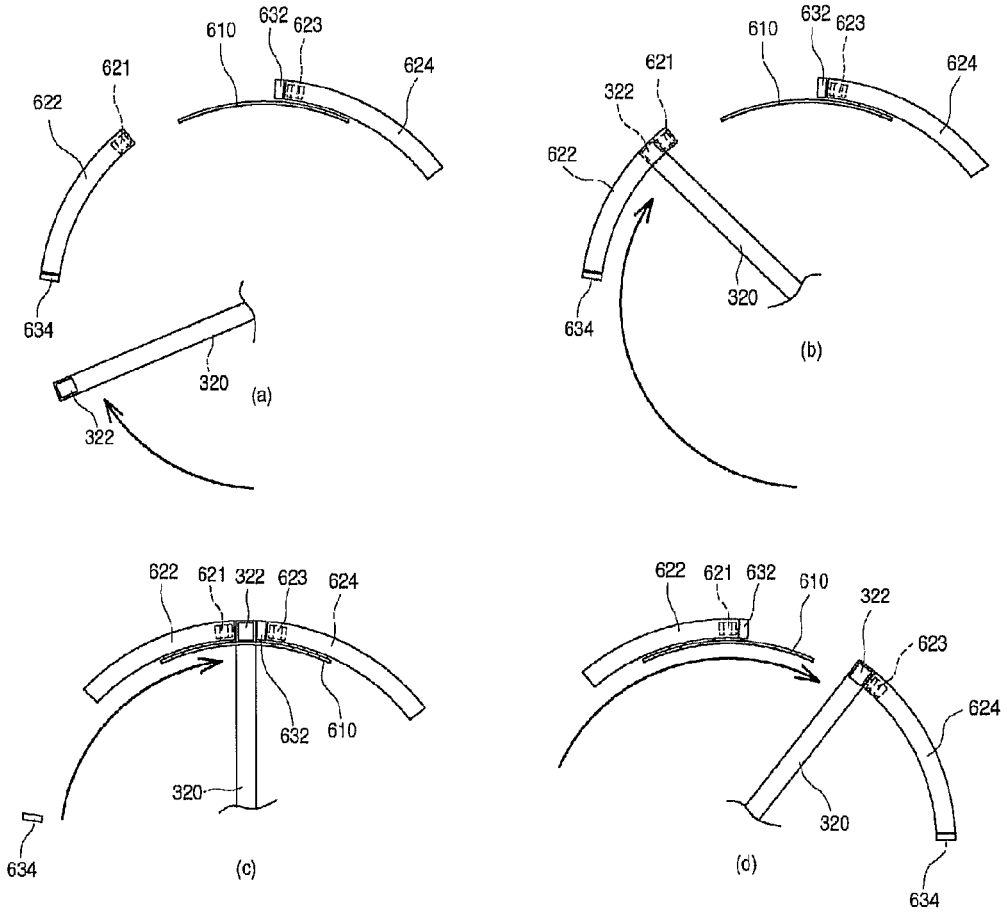
Figure 7:
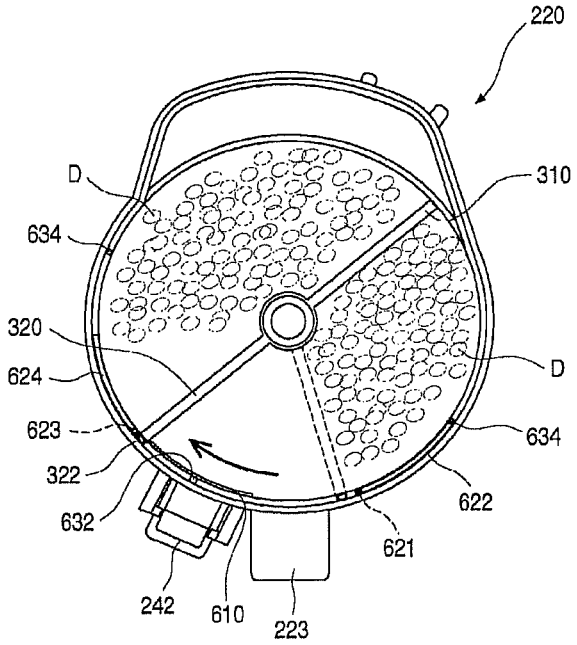
Figure 8:
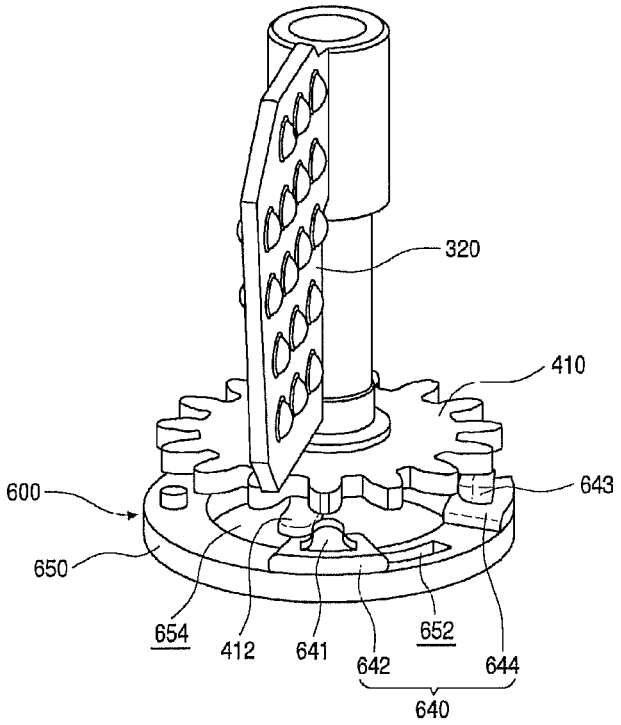
FIGS. 8 to 11 show configurations of another embodiment of the dust emptying notification unit, i.e., the principal part of the vacuum cleaner and the process visualizing emptying condition of the dust according to the disclosure.
Figure 9:
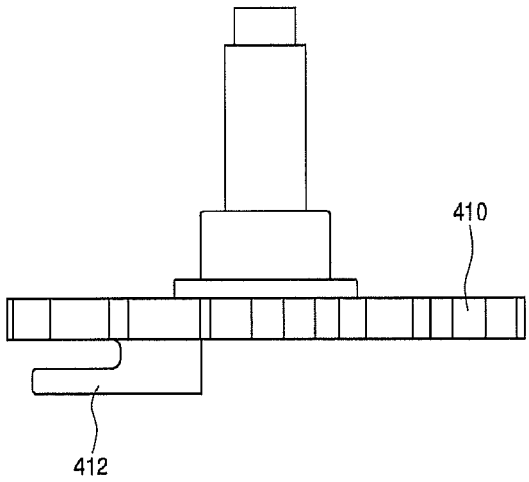

FIG. 4 shows an embodiment of a dust emptying notification unit, i.e., the principal part of the vacuum cleaner according to the disclosure. FIGS. 5 to 7 shows processes visualizing emptying condition of the dust through the dust emptying notification unit showed in FIG. 4.

When power supply is applied to the vacuum cleaner of the disclosure to suction the dust through the suction nozzle 20 by the user, the dust is introduced to the dust collecting unit 200 mounted in the body 100 together with the air.

Further, the dust introduced as above is separated from the air by the cyclone portion 211 and is collected in the dust collecting container 220. The dust collected by the pressurization member 310, 320 is compressed in the dust collecting container 220.

In the dust collecting container 220, the second pressurization member 320 rotates toward the first pressurization member 310 to compress the collected dust.

At this time, the second pressurization member 320 makes the slider 620 disposed at the top thereof to move while rotating-moving to compress the dust.

That is, the hanger protrusion 322 disposed at top of the second pressurization member 320 makes the slider 620 to move along traveling direction of the second pressurization member 320 while being interfered with the hanger protrusion 621, 623 formed in the slider 620.

When looking at above content through FIGS. 5 and 6 in more detail, as shown in FIG. 5A to 5C, if the second pressurization member 320 rotates counter-clockwise to compress the dust, the first hanger protrusion 621 of the first slider 622 makes the first slider 622 to move toward the left while being interfered with the interference protrusion 322.

Further, if the first slider 622 moves toward the left to contact the side stopper 634, the interference protrusion 322 overstrides the slant side formed in a side of the first hanger protrusion to continually rotate the second pressurization member 320.

Here, the second pressurization member 320 continues to rotate until the first pressurization member 310 and the collected dust is compressed to reach a peak in which the second pressurization member 320 cannot rotate further, and the second pressurization member 320 continues to pressurize the dust during a certain time to rotate clockwise after reaching the peak.

Here, in the second pressurization member 320, the peak, in which the second pressurization member 320 cannot rotate, is called the case in which the resistance force reaches the set value.

Further, when the resistance force reaches the set value, the power rotating the second pressurization member 320, i.e., power supply applied to the driving motor 430 is blocked during a certain time so that the second pressurization member 320 maintains the condition compressing the dust at stopping condition. After passing a certain time, the power supply is again applied to the driving motor 430 and the second pressurization member 320 may compress the dust while rotating clockwise as shown in FIG. 6.

On the other hand, when the second pressurization member 320 rotates clockwise as above, the first slider 622 moves clockwise from a point of time beginning the interference between the first hanger protrusion 621 of the first slider 622 positioned to be contacted with the side stopper 634 and the interference protrusion 322.

When the movement as above continues until the first slider 622 reaches the center stopper 632 and the first slider 622 contacts the center stopper 632, the interference protrusion 322 overstrides the side slant side of the first hanger protrusion 621.

At this time, the first slider 622 hides more than half of the front of the fixing plate 610 to expose the portion of the fixing plate 610 only.

The second pressurization member 320 making the first slider 622 move into the center stopper 632 moves clockwise when the second hanger protrusion 623 of the second slider 624 contacts the interference protrusion 322, and the fixing plate 610 is exposed to outside.

After the first slider 622 hides the portion of the fixing plate 610, when moving the second slider 624, the fixing plate 610 is exposed to the outside, thereby maintain almost the same an area of the fixing plate 610. Further, in such case, the user recognizes that the dust collecting container 220 has a spare space.

On the other hand, the second slider 624 also continues to move until reaching the side stopper 634 like the first slider 622, and after the second pressurization member 320 passing through the side stopper 634 compresses the dust during a certain time together with the first pressurization member 310.

The dust capacity is increased while repeating the same process as above, thereby gradually reducing a moving radius of the second pressurization member 320.

As above, when reducing a moving radius of the second pressurization member 320, the movement of the first slider 622 and the second slider 624 is also limited by compressed dust.

In detail, when the dust is continuously collected and compressed in the inside of the dust collecting container 220, the second pressurization member 320 makes the first slider 622 and the second slider 624 move up to near the side stopper 634 only, respectively but does not overstride the first hanger protrusion 621 and the second hanger protrusion 623 in the condition interfered with the side stopper 634 to change the rotation direction after elapsing a certain time.

Therefore, as shown in FIG. 7, the second pressurization member 320 makes the first slider 622 move up to near one side of the side stopper 634, thereafter does not make the first slider 622 move near the central stopper 632, and moves in the direction of the second slider leaving behind the first slider 622 near the side stopper 634.

Further, the second pressurization member 320 moving toward the second slider 624 makes the second slider 624 move up to near the other side of the side stopper 634 and is directed to the central stopper 632 leaving behind the second slider 622 near the side stopper 634, like the first slider 622.

Therefore, in the same condition as above, since the fixing plate 610 is not shielded by the slider 620, the entire area thereof is exposed. The user checks the fixing plate 610 exposed as above and may check emptying time of a dust container.

On the other hand, FIGS. 8 to 11 show configurations of another embodiment of the dust emptying notification unit, i.e., the principal part of the vacuum cleaner and the process visualizing emptying condition of the dust according to the disclosure.

In the description of another embodiment of the disclosure to be described below, the configuration of the same function and name as the previous embodiment is noted as the same reference numerals for convenience of description and the detailed description thereof will be omitted.

In another embodiment of the disclosure, the protrusion portion 412 interfered with the dust emptying notification unit 600 according to another embodiment to be described below is formed to be protruded toward the outside at the passivity gear 410 of one configuration of the driving device 400

The protrusion portion 412 is formed to be slightly more protruded toward the outside from tooth profile of the passivity gear 410 and the side thereof is formed to be rounded. The protrusion portion 412 is interfered with a slip moving portion 640 to be described below, thereby overstriding the slip moving portion 640 and moving when applying above a certain pressure.

Further, the bottom of the passivity gear 410 is provided with the dust emptying notification unit 600.

In detail, the dust emptying notification unit 600 includes a pair of slip moving portion 640 interfered with the protrusion portion 412 and sliding-moving, a guide member 650 disposed at the bottom of the passivity gear 410 and guiding moving position of the slip moving portion 640, and a pair of bin-full sensing switch 662, 664 disposed at the guide member 650 and generating bin-full sensing signal according to moving position of the slip moving portion 640.

The guide member 650 is formed by a size and form including the trajectory formed by the protrusion portion 412 so that the trajectory formed by the end of the protrusion portion 412 is formed in the top of the guide member 650. In the guide member 650, A motor axis of the driving device 400 is penetrated and a motor axis connection hole 654 connecting the passivity gear 410 and the second pressurization member 320 is punched the center thereof.

Figure 10:
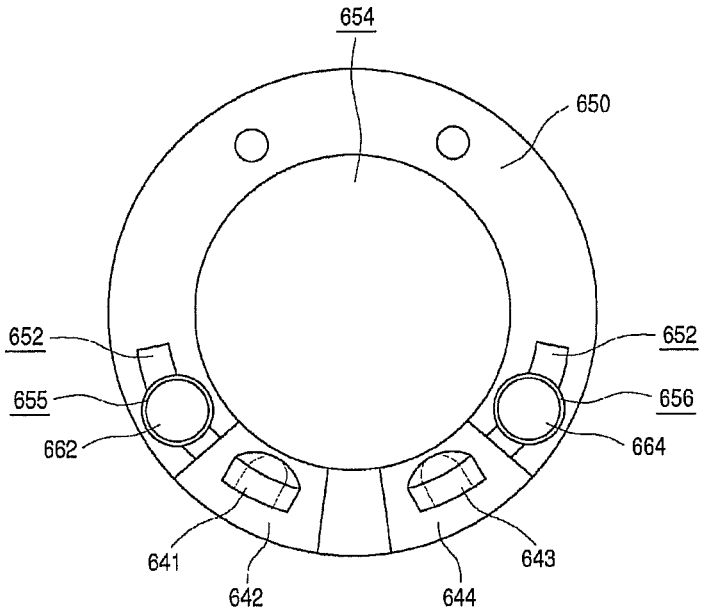

Further, the slip moving portion 640 is mounted in the guide member 650 to form a pair of slit to be sled-moved, and the slits 652 is provided with the bin-full sensing switches 662, 664 generating control signal for bin-full sensing at the end of a receding direction from each other, respectively (refer to FIG. 10).

Further, each of the bin-full sensing switches 662, 664 include a first bin-full sensing switch 662 to be switched on/off by the first slip moving portion 642, and a second bin-full sensing switch 664 to be individually switched on/off by the second slip moving portion 664, and are mounted in a first switch accommodating portion 655 and a second switch accommodating portion 655 provided at the slit 652, respectively.

On the other hand, a first protrusion 641 and a second protrusion 643 interfered with the protrusion 412 is formed in the first slip moving portion 642 and the second slip moving portion 664, respectively.

In detail, the first protrusion 641 is protruded upward from the top of the first slip moving portion 642 to be interfered with the protrusion 412, and the second protrusion 643 is protruded upward from the top of the second slip moving portion 644 to be interfered with the protrusion 412

Further, the side of the first protrusion 641 and the second protrusion 643 are rounded to have a certain curvature like the side of the protrusion 412. when pressurizing above a certain pressure to the protrusion 412, the protrusion 412 may overstride the first protrusion 641 and the second protrusion 643.

Figure 11:
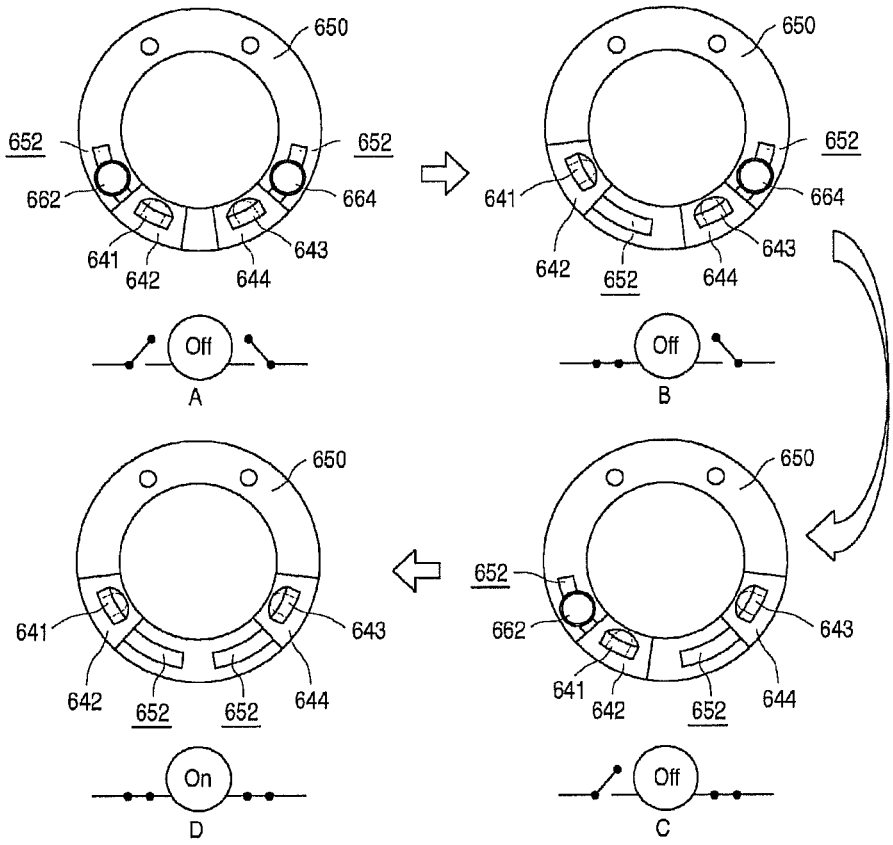
Figure 12:
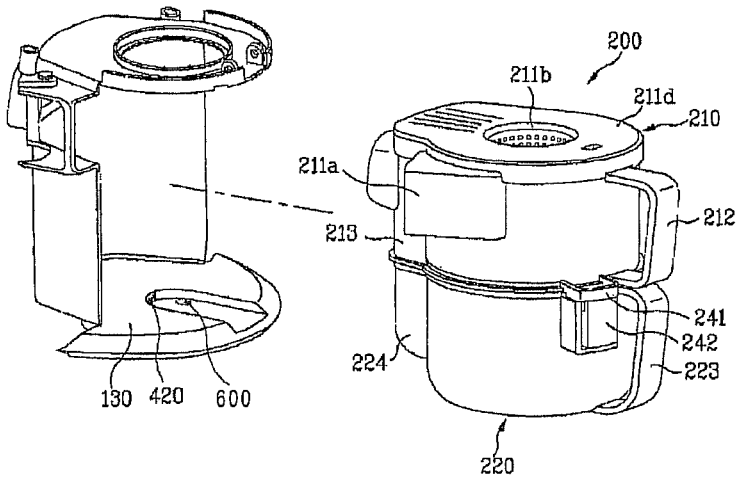
FIGS. 12 to 16 show the configurations of another embodiment of the dust emptying notification unit, i.e., the principal part of the vacuum cleaner and the process visualizing emptying condition of the dust according to the disclosure.
Figure 13:
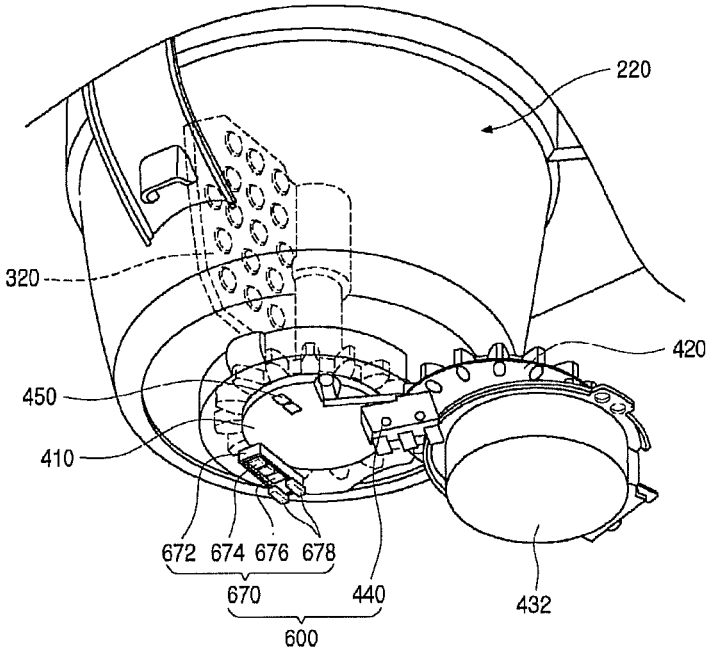
Figure 14:
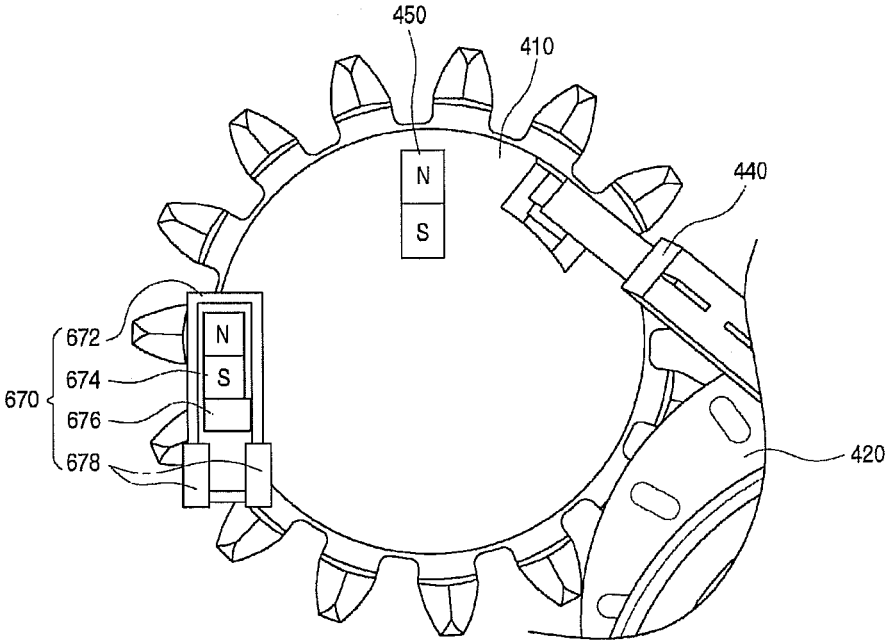

Therefore, when the space accommodating the dust is sufficient in the inside of the dust collecting container 220, the protrusion 412 rotates with moving radius including all the slit 652 and makes the slip moving portion 640 move from one end of the slit 652 to the other end as shown in FIG. 11.

However, when the space accommodating the dust is not sufficient in the inside of the dust collecting container 220, the second pressurization member 320 rotates with moving radius not including all the slit 652 and does not make the second slip moving portion 644 move toward the first slip moving portion 642 by switching on the second bin-full sensing switch 664 by the second slip moving portion 644.

Further, in the same condition as above, if the second pressurization member 320 rotates to move the first slip moving portion 642 and dose not make the first slip moving portion 642 move toward the second slip moving portion 644 after switching on the first bin-full sensing switch 662, both of the first bin-full sensing switch 662 and the second bin-full sensing switch 664 are switched on to notice fullness of the dust collecting container 220 of an notification portion 520 provided at the body 100 by the controller (refer to FIG. 1).

The notification portion 520 notices fullness of the dust collecting container 220 by illuminating colored light or flickering an illuminant through the illuminant.

On the other hand, in another embodiment of the disclosure, the dust emptying notification unit 600 operating the notification portion 520 using magnetism is provided like the previous embodiment.

FIGS. 12 to 16 show the configurations of another embodiment of the dust emptying notification unit, i.e., the principal part of the vacuum cleaner and the process visualizing emptying condition of the dust according to the closure.

As shown in these drawings, in another embodiment of the disclosure, a main magnet 450 operating the dust emptying notification unit 600 of another embodiment to be described in detail below by the magnetism while rotating for the passivity gear 410 of one configuration of the driving device 400 described in the previous embodiment is provided.

Further, the body 100 includes an notification portion 520 noticing dust emptying time within the dust collecting container 220 through the luminant, and a microswitch 440 sensing moving time and rotation times of the second pressurization member 320 and generating control signal for lighting the notification portion 520.

Here, when both of the dust emptying notification unit 600 and the micro switch 440 are operated, the notification portion 520 is configured to notice the condition in which the dust emptying is required.

Further, the dust emptying notification unit 600 includes a sub-magnet 674 sliding-moving in response to magnetic field formed by the main magnet 450, a magnet housing 672 providing sliding moving course of sub-magnet 674, a lead wire 678 disposed at one side of the magnet housing 672 and forming switch contact for operating the notification portion 520, and a conductor 676 disposed at one side of the sub-magnet 674, sliding-moving and contacting the lead wire 678 according to sliding position of the sub-magnet 674.

On the other hand, when the cleaning operations is performed by supplying the power supply to the vacuum cleaner of an embodiment configured as above, the dust is collected into the inside of the dust collecting container 220, and the collected dust is compressed by interaction between the second pressurization member 320 and the first pressurization member 310 like the previous embodiment to make the dust emptying notification unit 600 and the microswitch 440 operate.

In detail, the microswitch 440 is pressurized and operated by the passivity gear 410 and senses pulse output generated during a certain time.

In detail, in the microswitch 440, times pressed by the second pressurization member 310 or the pressurized time is sensed to sense the accommodation condition of the dust for the dust collecting container 220 by change of the pulse output according to the change of the times and time, and one of signals noticing fullness of the dust collecting container 220 is generated by not pressurizing during a certain time.

When the value obtained by counting the tooth profile of the passivity gear 410 is within the set count value, the accommodating space of the dust collecting container 220 is sufficient, and when the value obtained by counting the tooth profile of the passivity gear 410 is below the set count value, the control signal noticing fullness of the dust collecting container 220 is generated.

On the other hand, the dust emptying notification unit 600 makes the sub-magnet 674 slide-move in the inside of the magnet housing 672 by the main magnet 450 disposed at the passivity gear 410 transmitting the rotation force to the second pressurization member 320 and rotating together with the passivity gear 410.

Figure 15:
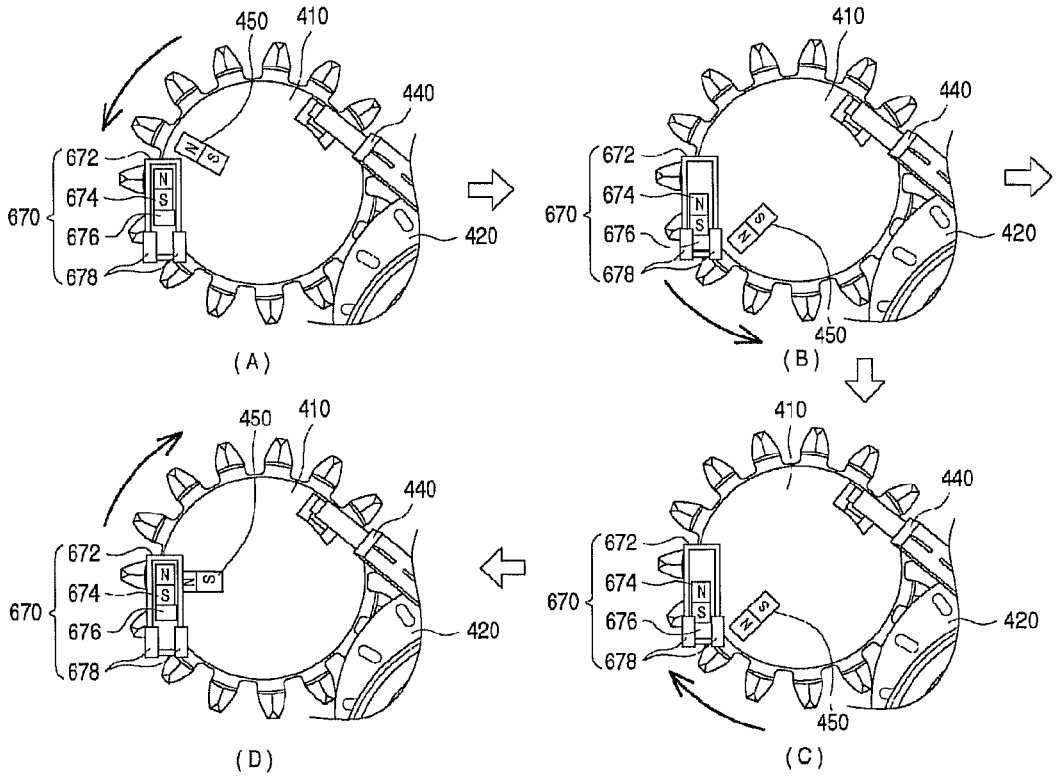
Figure 16:
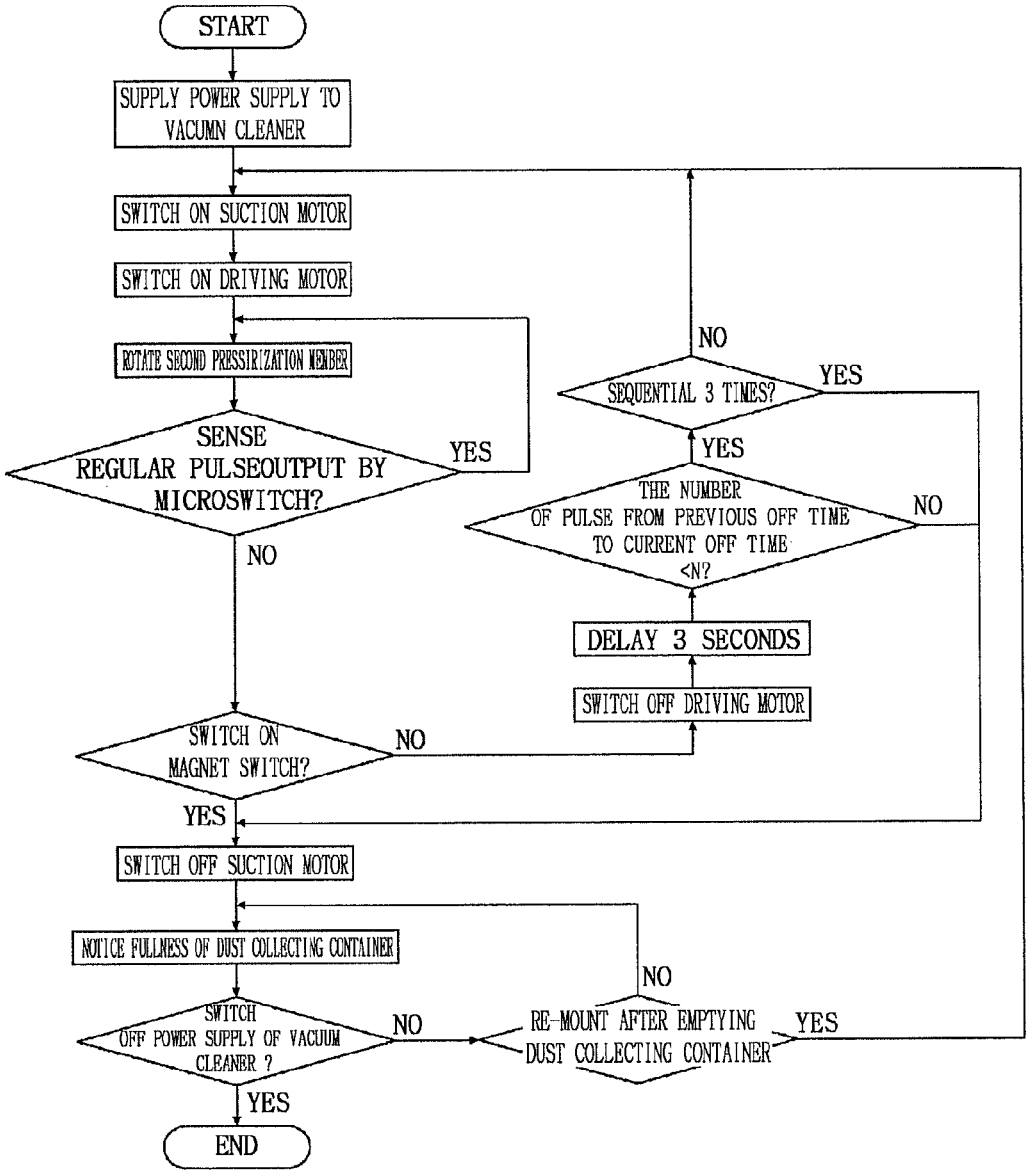
Figure 17:
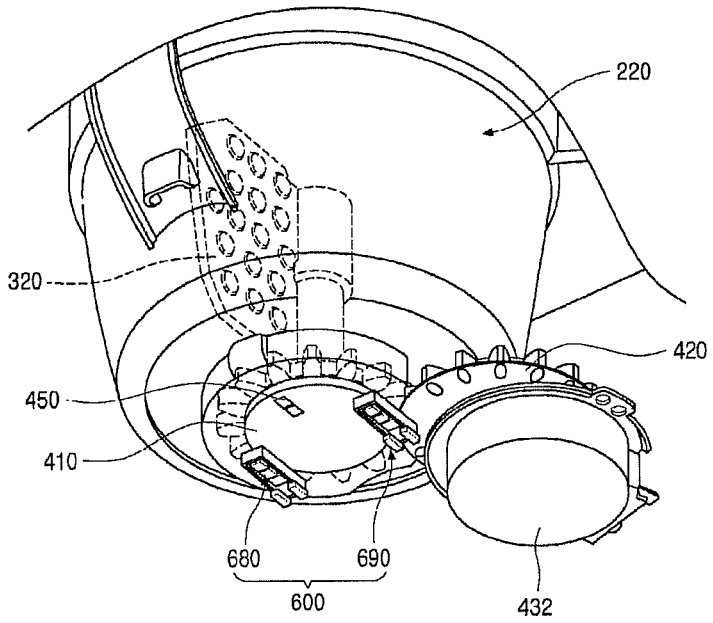
FIGS. 17 to 21 show the configurations of another embodiment of the dust emptying notification unit, i.e., the principal part of the vacuum cleaner and the process visualizing emptying condition of the dust according to the disclosure.
Figure 18:
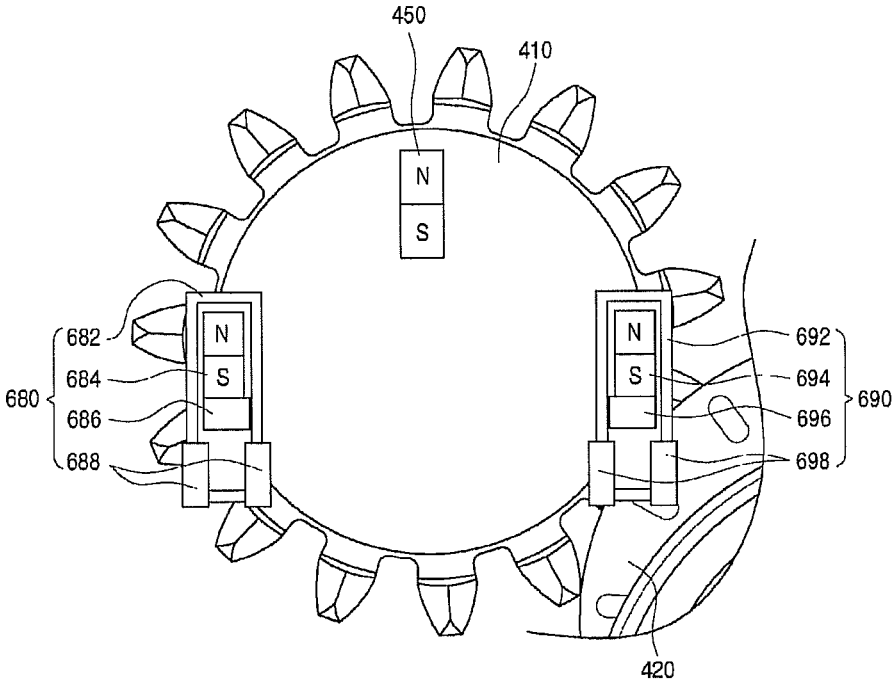
Figure 19:
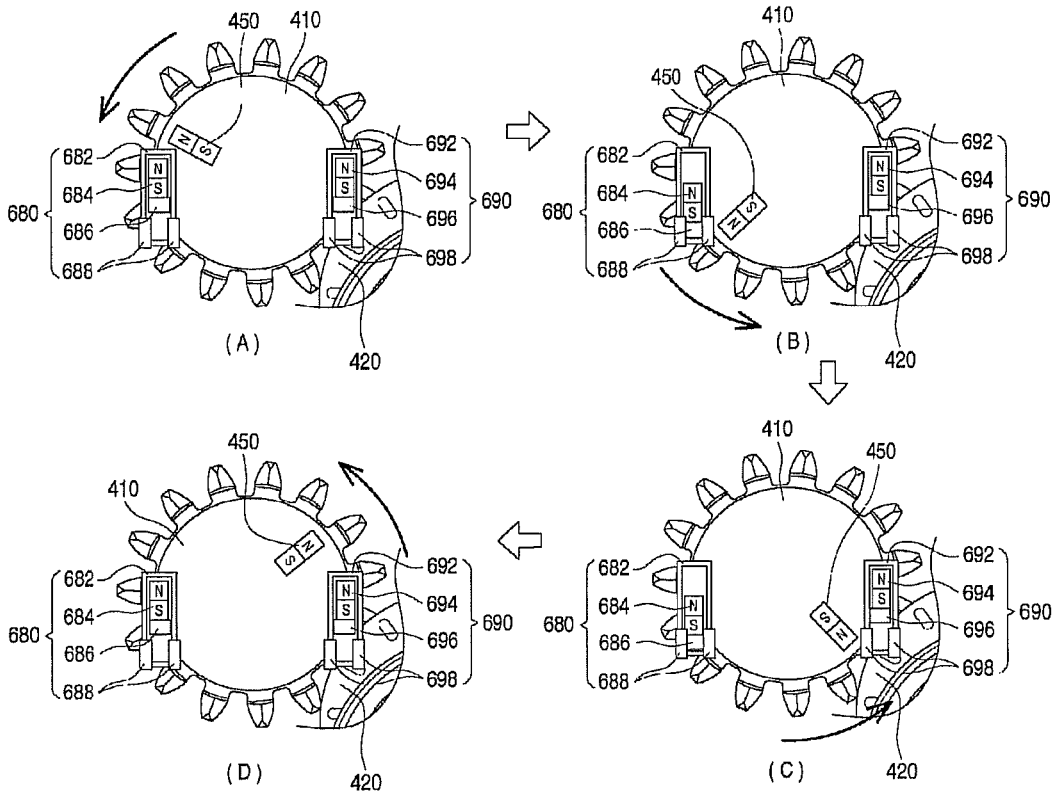
Figure 20:
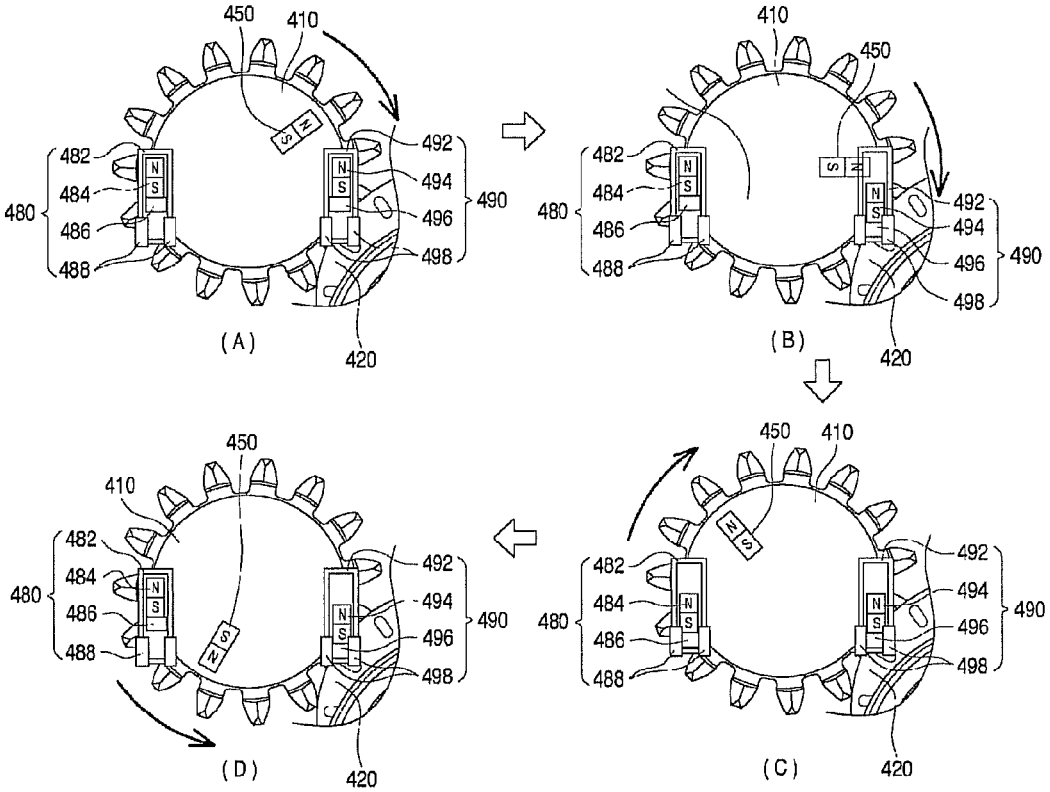
Figure 21:
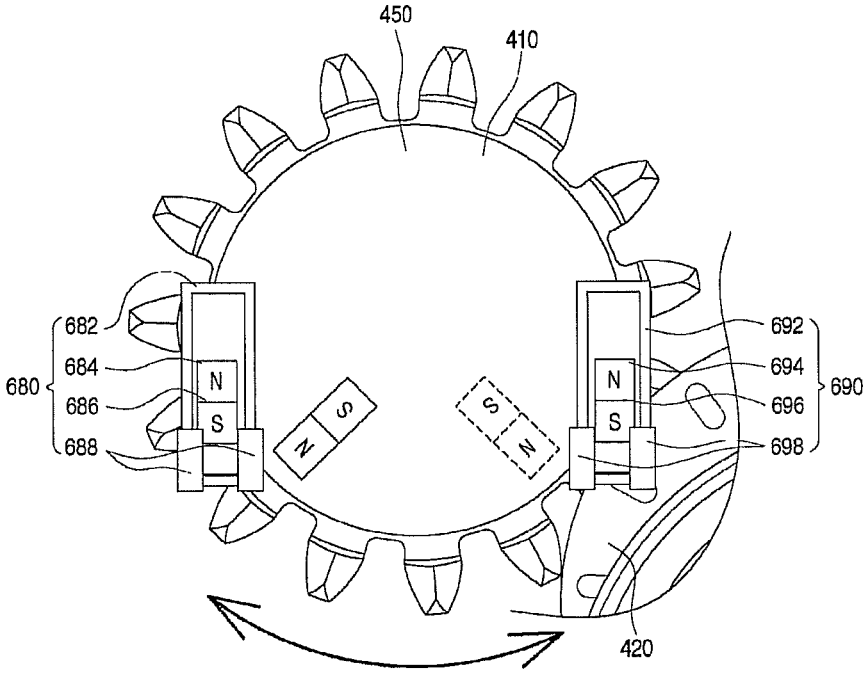

In detail, as shown in FIG. 15, when the passivity gear 410 rotates to compress the dust by rotating the second pressurization member 320, the main magnet 450 rotates counter-clockwise as shown in FIGS. 15A and N pole of the main magnet 450 is drawn to N pole of the sub-magnet 674.

Therefore, the sub-magnet 674 is sled-moved from the inside of the magnet hosing 672 to the bottom by repulsive force and therefore, the conductor 676 connected to the sub-magnet 674 generates the control signal noticing fullness of the dust collecting container 220 (refer to FIG. 15B) while contacting the leadwire 678 provided at the bottom end of the magnet housing 672.

On the other hand, after the second pressurization member 320 compresses the dust during a certain time by interaction with the first pressurization member 310, power supply of the driving device 400 is reversed to make the second pressurization member 320 rotate clock-wise as shown in FIG. 15C.

As above, if the second pressurization member 320 rotates clock-wise, N pole of the main magnet 450 is drawn to S pole of the sub-magnet 674 to generate attractive force. the sub-magnet 674 moves from the inside of the magnet housing 672 to the top along with the rotation direction of the main magnet 450.

Further, in such case, the leadwire 678 is separated from the conductor 676 not to generate the control signal.

While repeating the same process as above, the accommodating amount of the dust for the dust collecting container 220 is increased. If the accommodating amount of the dust is above a certain amount, the pressurization times and time of the microswitch 440 becomes below the set value by the passivity gear 410.

Further, in the same condition as above, the rotation radius of the second pressurization member 320 is limited by the collected dust. Therefore, the main magnet 450 is drawn to the sub-magnet 674 to make the sub-magnet 674 move into the bottom by the repulsive force. After that, the sub-magnet 674 is not moved into the top by the attractive force again to flow right and left. Hence, the control signal passing through the dust emptying notification unit 600 is generated to show fullness of the dust collecting container 220 through the notification portion 520 to the outside.

On the other hand, in another embodiment of the disclosure, the dust emptying notification unit 600 including the first magnet 680 and the second magnet 690 instead of the microswitch 440 of the previous embodiment is disposed.

FIGS. 17 to 21 show the configurations of another embodiment of the dust emptying notification unit, i.e., the principal part of the vacuum cleaner and the process visualizing emptying condition of the dust according to the closure.

In drawing, in another embodiment of the disclosure, a second magnet switch 690 generating the control signal instead of the first magnet switch 680 and the microswitch 440 of the previous embodiment is disposed at the bottom of the passivity gear 410.

The first magnet switch 680 includes a first magnet 684 sliding-moving in response to magnetic field formed by the main magnet 450, a first magnet housing 682 providing sliding moving course of the first magnet 684, a first lead wire 688 disposed at one side of the first magnet housing 682 and forming switch contact for operating the notification portion, and a first conductor 686 disposed at one side of the first magnet 682, sliding-moving and contacting the first lead wire 688 according to sliding position of the first magnet 682.

Further, the second magnet switch 690 includes a second magnet 694 sliding-moving in response to magnetic field formed by the main magnet 450, a second magnet housing 692 providing sliding moving course of the second magnet 694, a second lead wire 698 disposed at one side of the second magnet housing 692 and forming switch contact for operating the notification portion 520, and a second conductor 696 disposed at one side of the second magnet 692, sliding-moving and contacting the second lead wire 698 according to sliding position of the second magnet 692.

Therefore, the dust emptying notification unit 600 configured as above makes the first magnet switch 680 and the second magnet switch 690 operate by the repulsive force and the attractive force by rotating the passivity gear 410 like the previous embodiment.

Further, when the first conductor 686 of the first magnet switch 680 operated as above contacts the first leadwire 688 and the second conductor 696 of the second magnet switch 690 contacts the second leadwire 698 to generate the control signal, the notification portion 520 notices fullness of the dust collecting container 220 of the outside.

As shown in drawings above, the disclosure describes a canister type of the vacuum cleaner as an embodiment of the vacuum cleaner according to the disclosure but is limited to the embodiment described above, and may apply to a upright type of the cleaner or robot cleaner.

What is claimed is:

1. A vacuum cleaner, comprising;

a body;

a dust collecting unit disposed at one side of the body and provided with a dust collecting container storing the dust;

a pressurization member compressing the dust stored in the dust collecting container;

a driving device operating the pressurization member; and a dust emptying notification unit noticing the dust emptying time by visualizing a storage condition of the dust within the dust collecting container while sliding-moving by operating the pressurization member, wherein the pressurization member is provided with an interference protrusion to enable the dust emptying notification unit to slide-move by transmitting driving force of the driving device to the dust emptying notification unit.

2. The vacuum cleaner according to claim 1, wherein the dust emptying notification unit includes:

a pair of slider sliding-moving along with the inside of the dust collecting container, and a fixing plate fixed at the inside of the dust collecting container to be positioned in parallel with moving course of the sliders at the rear side of the sliders and changing area exposed to the outside according to moving position of the slider, the slider is provided with a hanger protrusion interfered with the interference protrusion.

3. The vacuum cleaner according to claim 2, wherein a number of stopper limiting movable position of the slider is disposed at moving course of the slider.

4. The vacuum cleaner according to claim 3, wherein the stopper includes:

a central stopper disposed at the center of the fixing plate, and a side stopper positioned to be spaced into above size of each of the slider in the direction separated from the central stopper on moving course of the slider.

5. The vacuum cleaner according to claim 4, wherein the hanger protrusion formed on the slider is formed in the direction close to the central stopper.

6. The vacuum cleaner according to claim 4, wherein when the moving course of the pressurization member includes both of the center stopper and the side stopper, the moving position of the slider is changed to expose the portion of the fixing plate only, when the moving course of the pressurization member includes the center stopper only, the slider maintains a fixed position to expose the whole fixing plate to the outside.

7. A vacuum cleaner, comprising;

a body;

a dust collecting unit disposed at one side of the body and provided with a dust collecting container storing the dust;

a pressurization member to compress the dust stored in the dust collecting container;

a driving device to operate the pressurization member;

a dust emptying notification unit operated by the driving device with sliding-movement;

an notification portion to notice fullness of the dust collecting container; and a controller to control the notification portion based on the operating of the dust emptying notification unit.

8. The vacuum cleaner according to claim 7, wherein the driving device is provided with a passivity gear to enable the dust emptying notification unit to slide-move by transmitting driving force of the driving device to the dust emptying notification unit.

9. The vacuum cleaner according to claim 8, wherein the protrusion portion protruded toward the outside and interfered with the dust emptying notification unit is formed in the passivity gear.

10. The vacuum cleaner according to claim 9, wherein the dust emptying notification unit includes a pair of slip moving portion interfered with the protrusion portion and sliding-moving;

a guide member guiding moving position of the slip moving portion at the bottom of the passivity gear, and a pair of bin-full sensing switch disposed at the guide member and generating the bin-full sensing signal according to moving position of the slip moving portion, when the whole a pair of the bin-full sensing switch are switched on, the emptying situation of the dust may be noticed.

11. The vacuum cleaner according to claim 10, wherein the guide member is formed with a slit accommodating the slip moving portion, and the bin-full sensing switch is positioned to be slanted to one side of the slit and operated by the slip moving portion.

12. The vacuum cleaner according to claim 7, wherein the body includes:

a main magnet disposed at one side of the driving device and operating the dust emptying notification unit by magnetism while rotating, and a microswitch sensing moving time or rotation times of the pressurization member to generate control signal for lighting the notification portion, when both of the dust emptying notification unit and the microswitch are operated, the notification portion is configured to notice the condition in which the dust emptying is required.

13. The vacuum cleaner according to claim 12, wherein the dust emptying notification unit includes a sub-magnet sliding-moving in response to magnetic field formed by the main magnet, a magnet housing providing sliding moving course of the sub-magnet, a lead wire disposed at one side of the magnet housing and forming switch contact for operating the notification portion, and a conductor disposed at one side of the sub-magnet to move and contacting the lead wire according to sliding position of the sub-magnet.

14. The vacuum cleaner according to claim 7, wherein the body includes:

a pair of dust emptying notification unit providing operation signal to the notification portion according to sliding-moving position, a main magnet disposed at one side of the driving device and sliding-moving the dust emptying notification unit by magnetism while rotating, when the whole a pair of the dust emptying notification unit is sled-moved to provide the operation signal, the notification portion is configured to notice the condition in which the dust emptying is required.

15. The vacuum cleaner according to claim 14, wherein the dust emptying notification unit includes a sub-magnet sliding-moving in response to magnetic field formed by the main magnet, a magnet housing providing sliding moving course of the sub-magnet, a lead wire disposed at one side of the magnet housing and forming switch contact for operating the notification portion, and a conductor disposed at one side of the sub-magnet to slide-moving and contacting the lead wire according to sliding position of the sub-magnet.

16. A vacuum cleaner, comprising;

a body;

a dust collector provided at one side of the body and provided with a dust collecting container storing the dust;

a plate to compress the dust stored in the dust collecting container;

a drive module configured to rotate the plate; and a pair of slider sliding-moving along with the inside of the dust collecting container; and a fixing plate fixed at the inside of the dust collecting container to be positioned in parallel with moving course of the sliders at the rear side of the sliders and changing area exposed to the outside according to moving position of the slider, wherein the slider is provided with a hanger protrusion interfered with the interference protrusion.

* * * * *